US008739722B2

(12) United States Patent
Liberg

(10) Patent No.: US 8,739,722 B2
(45) Date of Patent: Jun. 3, 2014

(54) TANK ARRANGEMENT ADAPTED FOR A SUBMERSIBLE PUMP

(75) Inventor: Lars-Olof Liberg, Strömstad (SE)

(73) Assignee: GVA Consultants AB, Gothenburg (SE)

( * ) Notice: Subject to any disclaimer, the term of this patent is extended or adjusted under 35 U.S.C. 154(b) by 450 days.

(21) Appl. No.: 12/782,772

(22) Filed: May 19, 2010

(65) Prior Publication Data

US 2011/0126749 A1 Jun. 2, 2011

Related U.S. Application Data

(60) Provisional application No. 61/179,416, filed on May 19, 2009.

(30) Foreign Application Priority Data

May 19, 2009 (SE) ..... 0950358

(51) Int. Cl.
*B63B 43/06* (2006.01)

(52) U.S. Cl.
USPC ..... 114/125

(58) Field of Classification Search
CPC ..... B46B 11/04; B46B 13/00; B46B 25/08; B46B 25/12; B63J 4/002
USPC ..... 114/125, 65 R, 74 R, 183 R; 415/56.1
See application file for complete search history.

(56) References Cited

U.S. PATENT DOCUMENTS

| | | | | |
|---|---|---|---|---|
| 1,410,287 | A * | 3/1922 | Ebsen | 114/74 R |
| 2,710,586 | A * | 6/1955 | Shelton | 114/74 R |
| 3,304,877 | A * | 2/1967 | Carter et al. | 417/372 |
| 3,336,930 | A | 8/1967 | Shibata et al. | |
| 3,895,885 | A | 7/1975 | Liberg | |
| 4,314,519 | A | 2/1982 | Yunoki et al. | |
| 4,492,532 | A | 1/1985 | Csemniczky et al. | |
| 4,715,309 | A * | 12/1987 | Liberg | 114/125 |
| 5,141,390 | A | 8/1992 | Haentjens | |
| 5,549,131 | A * | 8/1996 | Maxwell et al. | 137/115.18 |
| 6,250,889 | B1 * | 6/2001 | Shepard | 417/89 |
| 7,334,600 | B2 * | 2/2008 | Scott | 137/202 |
| 8,025,463 | B2 * | 9/2011 | Foo et al. | 405/224.1 |
| 2004/0131427 | A1 | 7/2004 | Wybro et al. | |
| 2006/0137663 | A1 * | 6/2006 | Vaught | 123/516 |

* cited by examiner

*Primary Examiner* — Stephen Avila
*Assistant Examiner* — Andrew Polay
(74) *Attorney, Agent, or Firm* — Gary M. Machetta

(57) ABSTRACT

The present invention relates to a ballast system for a marine structure. The ballast system comprises a ballast tank which is in fluid communication with a tank arrangement for temporarily holding bilge fluid and/or ballast fluid in a marine structure. The tank arrangement comprises a storage space defined by at least one tank wall, at least one fluid inlet for introducing the bilge fluid and/or ballast fluid in the storage space, and at least one fluid outlet permitting removal of at least parts of the bilge fluid and/or ballast fluid from the storage space. The at least one fluid outlet is at least partly formed by a caisson adapted for receiving a submersible pump at a submersible pump position in the storage space.

23 Claims, 6 Drawing Sheets

TANK ARRANGEMENT ADAPTED FOR A SUBMERSIBLE PUMP

CROSS-REFERENCE TO RELATED APPLICATIONS

This application claims benefit of U.S. Provisional Patent Application No. 61/179,416, filed on May 19, 2009 and of Swedish Patent Application 0950358-2 filed on May 19, 2009.

BACKGROUND

1. Field

The present invention relates to a tank arrangement for a marine structure. The tank arrangement is adapted for a submersible pump, the tank arrangement comprises a circulation conduit for circulating liquid to enable the submersible pump to operate in an advantageous condition substantially at all time. The present invention also relates to an assembly of a submersible pump and a tank arrangement.

2. Background of the Invention

A marine structure, such as a ship or a semi-submersible unit, is often provided with one or more ballast systems in order to control the draught and/or the inclination of the marine structure. Generally, a ballast system comprises a ballast tank, and in fact often a plurality of tanks, which is adapted to be filled with sea water—i.e. water ambient of the marine structure—through a water filling assembly.

In order to be able to empty or to transfer water between tanks, the ballast system further generally comprises a pump assembly which in turn comprises a pump and means for fluidly connecting the tank and the pump as well as means for connecting the pump and the environment ambient of the marine structure such that water may be pumped from the tank to the ambient environment. Generally, at least a portion of the pump assembly is in fluid communication with the aforesaid water filling assembly.

However, in some operations, intrusion of air cannot be avoided. For example, when a ballast tank is drained of water, there is a risk that air, at low tank level in the ballast tank, will be mixed with ballast water and guided towards to, and later introduced into the pumps such that air will be entrained in the water filling assembly and—at a later stage—in at least a portion of the pump assembly. As such, when a ballast tank is to be emptied of water, there is a risk that the air in the pump assembly will be guided towards the pump and hence introduced in the pump. Since air generally adversely affects a pump, the presence of air is undesired. Moreover, at the completion of a ballast tank emptying operation, i.e. when a ballast tank is almost completely emptied of water, the water flow from the ballast tank to the pump is generally lower than in the beginning of the ballast tank emptying operation. Since a pump generally has an optimum operating condition at a specific combination of the flow rate and pressure, the aforesaid change in the water flow is generally undesired.

Additionally, during load altering operations of the marine structure, such as multiple ballast operations and/or oil refueling, which occur simultaneously as a ballast tank emptying operation, there may be a need for controlling the rate at which the ballast tank is emptied in order to maintain a balance in the marine structure. Moreover, when a ballast tank is almost emptied of water, it may be desirable to have a low flow rate of the water leaving the ballast tank in order to at least limit the amount of air in the water entering the pump.

Pumping ballast water usually requires relatively high capacity pumps while when pumping bilge water, generally low capacity pumps are required. The difference in requirements of the pumps tends to be burdensome for the manufacturer of the marine structure as it demands two different pumps, each specifically adapted for the operating condition required for the specific purpose of the pump. Further, if the marine structure is damaged, it remains vital that the ballast pumps and bilge water pumps are operational, even if the hull is breached or the space at which the pumps are positioned is flooded. Today, this is often solved by having a plurality of pump rooms at different locations; this ensures that always one ballast pump or bilge water pump remains operational.

In view, of the above, it may be realized that there is a need for improvements in the field of moving fluids.

SUMMARY OF THE INVENTION

The above mentioned drawbacks are at least partly solved or at least partly reduced by a tank arrangement according to the present invention and more specifically, a tank arrangement for temporarily hold bilge fluid and/or ballast fluid in a marine structure. The tank arrangement comprises a storage space defined by at least one tank wall, at least one fluid inlet for introducing the bilge fluid and/or ballast fluid in the storage space, and at least one fluid outlet for permitting removal of at least parts of the bilge fluid and/or ballast fluid from the storage space. The at least one fluid outlet is at least partly formed by a caisson adapted for receiving a submersible pump at a submersible pump position in the storage space. The submersible pump comprises a high side and a low side. The caisson comprises at least one circulation conduit having an inlet and an outlet, adapted to enable circulation of at least parts of the bilge fluid and/or ballast fluid in the caisson from the high side of the submersible pump to the low side of the submersible pump, when the submersible pump is in the submersible pump position.

The present invention provides for a tank arrangement which can be utilized with a submersible pump. The tank arrangement enables a submersible pump for pumping e.g. bilge water or ballast water while being constantly submerged in water, thereby removing the risk of failure during start up due to air in the pump, or insufficient pump fluid. By having a tank arrangement which is adapted for a submersible pump, and by using a submersible pump, the tank arrangement is less susceptible for the risks involved when pump rooms are flooded, e.g. during a hull breach. Thus, bilge water and/or ballast water pumping becomes less exposed for failure due to flooding of the pump. The tank arrangement can be operated to separate air entering the storage space together with the incoming liquid, to be a temporarily storage chamber for circulation liquid and to maintain the a predetermined minimum level of liquid in the storage space, enabling the submersible pump to be substantially constantly submerged.

According to an aspect of the present invention, the at least one circulation conduit comprises at least one circulation flow valve for regulating the flow at the outlet of the circulation conduit. The circulation flow valve enables a controlled flow which in turn enables different operating conditions for the submersible pump so that the operating conditions can be adapted for a specific purpose, e.g. for pumping bilge water or ballast water. The outlet of the circulation conduit can advantageously be arranged in the proximity of the submersible pump position. Optionally, the outlet of the circulation conduit can be arranged at the low side of the submersible pump, when the submersible pump is arranged in the submersible pump position. The circulated water can thereby be directly propelled onto the low side of the submersible pump.

According to an embodiment of the present invention, the circulation conduit extends through the at least one tank wall into the storage space. As such the inlet of the circulation conduit is arranged to the caisson outside of the storage space, defined by the tank walls, and thereafter extends into the storage space. This enables e.g. a circulation flow valve to be positioned outside of the storage space while still permitting the advantages of the circulation conduit as mentioned above. In an embodiment according to the present invention, the inlet of the circulation conduit can be arranged within the tank wall defining the storage space, the circulation conduit can thereafter be arranged to extend outside of the storage space, to thereafter return into the storage space. There are several advantages with this which will be explained in greater detail below.

The caisson can be a long caisson, e.g. extending between the tank arrangement and the deck of the marine structure, or e.g. an intermediate caisson extending to a level substantially in the plane of the centre of balance of the marine structure, or optionally a short caisson, extending just past the tank wall defining the storage space. The caisson generally comprises a first and a second end. According to an embodiment of the present invention, the second end of the caisson is arranged to form the submersible pump position. The submersible pump position is adapted to receive the submersible pump enabling the submersible pump to operate with at least a first and a second operating condition. The submersible pump position can be adapted to seal around the submersible pump, preventing liquid or air leakage between the submersible pump and the caisson. Optionally the submersible pump itself can be equipped with means for sealing around the submersible pump, or a combination thereof is of course possible.

A closeable lid can advantageously be arranged at the first end of the caisson, this is especially advantageous when the caisson is a short caisson or not more than a recess in the into the storage space. The closeable lid can be arranged with means for permitting power and/or control cables to extend through the lid or to permit cables to be connected to the lid for power and/or control management of the submersible pump. Optionally the submersible pump itself can be provided with means of sealing the first end of the caisson. Advantageously this can be a circumferential seal flange extending around the periphery of the submersible pump. The submersible pump can thus be fixed to the caisson preventing the submersible pump from torque imparted by the flow of liquid or via e.g. rotating blades of the submersible pump, during operation. Additionally, any cables can be attached to the submersible pump at the dry side of the submersible pump, while permitting the wet side of the submersible pump extend down into the storage space of the tank arrangement. Thus the power cord/cables does not need to be constantly submerged, however, the benefits of a submerged pump, as described above and below are still achieved.

In an embodiment of the present invention, the caisson extends through the at least one tank wall into the storage space. The caisson can be arranged to extend in a substantially vertical direction, thereby permitting the submersible pump to be introduced into the storage space in a vertical direction. Optionally, the caisson can be arranged to extend in a substantially horizontal direction, thereby permitting the submersible pump to be introduced into the storage space in a horizontal direction. A combination of the above is possible, e.g. in a diagonal direction.

The caisson can be arranged to extend a distance D at least past the at least one tank wall, and away from the storage space of the tank arrangement. The distance D is about the range of 0.1-50 meters. For a short caisson the distance D is about 0.1-8 meters, preferably about 0.1-5 meters, more preferably about 0.2-2, even more preferably 0.2-1 meters. This permits a tank arrangement to which a submersible pump can be easily replaced, removed or serviced.

In an embodiment of the present invention, the tank arrangement comprises means for removing air, or excess air, from the storage space. This will prevent air from entering the submersible pump in an undesired manner. It may however permit air to be circulated back to the submersible pump and especially to the low side of the submersible pump. The means for removing the air from the storage space is advantageously arranged to the circulation conduit. In such an embodiment, the means for removing the air from the storage space comprises a priming ejector. The storage space can be adapted to enable air to raise to the top of the storage space, e.g. by having a dome or spherical formed structure of parts of a tank wall or arranged to the tank wall.

The priming ejector is advantageously promoting the air to be removed by means of the circulated liquid as motive power. This reduces the need for separate power sources for the individual functions. The priming ejector can be in fluid communication with an air discharge conduit, which in turn is arranged to discharge the air outside of the storage space, e.g. outside of the marine structure. This embodiment is a simple yet effective way of discharging the air.

However, optionally or even additionally, the priming ejector can be in fluid communication with an air discharge conduit which is arranged to discharge air inside the storage space. This solution enables the submersible pump to finally discharge the air from the storage space out through the outlet of the tank arrangement. Nevertheless, the priming ejector can be arranged with an ejector outlet for ejecting at least air. The ejector outlet of the priming ejector is in an embodiment arranged in the storage space and in the proximity of the submersible pump position to enable the submersible pump to remove the air. The means for removing the air is arranged to operate by means of the circulating flow in the circulation conduit as motive power.

The present invention further relates to a tank arrangement and submersible pump assembly. The assembly comprises a tank arrangement according to the accompanying claims, or optionally as described above, and a submersible pump. The submersible pump can advantageously be arranged with means for sealing the caisson. This submersible pump can be connected with cables at a dry side of the submersible pump, as this side is outside of the storage space. The cable and the connection still needs to be adapted for withstanding water, as this part of the marine structure could be flooded in case of an accident. Optionally, if the caisson comprises a lid, the submersible pump comprises a power and/or control cable with a sufficient length for removing the submersible pump from the submersible pump position without disconnecting the power and/or control cable.

The present invention provides for a tank arrangement which can be integrated in a conduit system of e.g. a ballast system, generally because it can be made within a generally confined space. It further has a high reliability of operation and service and can keep the submersible pump submerged at all times. The present invention can further provide a one-way flow into the tank arrangement, circulating parts of the water, and provide a one way out from the tank arrangement for the water.

DEFINITIONS

As used herein, the expression "pump" relates to any type of device being adapted to move a fluid (i.e. liquid and/or gas)

such that a higher pressure of the fluid is obtained. Moreover, the position of the pump wherein the fluid enters the pump is herein referred to as the "low side" whereas the position of the pump wherein the higher pressure fluid leaves the pump is herein referred to as the "high side".

As used herein, the expression "priming" relates to the removal of air from the low side of a pump, to enable a substantially normal water level in the pump, which in turn enables a substantially normal operation of the pump.

BRIEF DESCRIPTION OF THE DRAWINGS

The present invention will be described in greater detail with reference to the accompanying figures, in which.

DETAILED DESCRIPTION OF PREFERRED EMBODIMENTS

Figure 1:
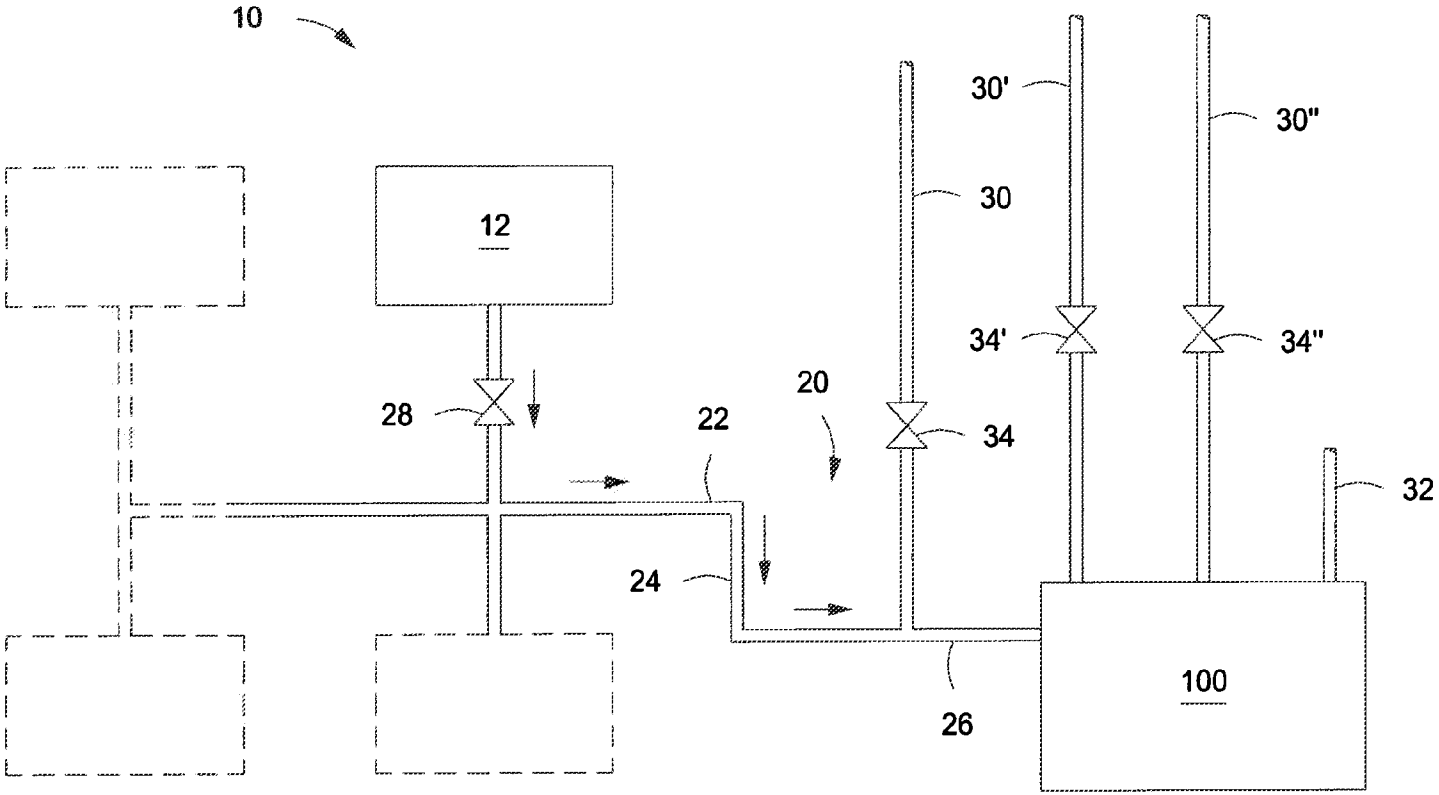
FIG. 1 shows a schematic illustration of a ballast system and tank arrangement according to the present invention.

FIG. 1 shows a schematic view of a ballast system 10 for de-ballasting water from the ballast tanks, to which a tank arrangement 100, according to the present invention, can be used. The ballast system 10 is preferably used in a marine structure (not shown), such as a ship, facility, semi submersible unit, or any other marine or floating unit, arranged in a body of water with a sea level. Purely by way of example, the ballast system 10 may preferably be used in a semi-submersible unit, i.e. a vessel having a deck and a float and one or more supporting columns connecting the deck and the float to one another. It should be noted that a marine structure may be provided with a plurality of ballast systems 10 and, in particular, a semi-submersible unit may be provided with one ballast system 10 per supporting column (not shown). The ballast system 10 of the present invention comprises at least one ballast tank 12. Generally, a ballast system 10 comprises a plurality of ballast tanks as indicated by the dotted lines in FIG. 1.

The ballast system 10 also comprises a first inlet conduit 20, also referred to with reference 110 below, adapted to provide a fluid communication between at least the ballast tank 12 and a tank arrangement 100, according to one embodiment of the present invention. In FIG. 1, the first inlet conduit 20 includes a plurality of pipe sections 22, 24, 26 which are connected to one another so as to form the first inlet conduit 20 although one continuous pipe may be used. Moreover, the first inlet conduit 20 preferably comprises a valve 28 for controlling the liquid flow in and/or out of the ballast tank 12.

The ballast system 10 further comprises a bilge water supply conduit 30 and a liquid discharge assembly 32 wherein the bilge water supply conduit 30 may be connected to the first inlet conduit assembly 20, preferably through a valve 34, whereas the liquid discharge assembly 32 generally is in fluid communication with the outlet of the tank arrangement 100, as will be described in greater detail below. Generally, the liquid used in the ballast system 10 is sea water but in some specific applications, other liquids may be used such as oil, diesel, liquid fossil fuel or the like. For the purpose of illustrating the present invention in a non limiting way, sea water is used as liquid. The first inlet conduit 20, 110, can be at least one inlet or a plurality of inlets.

Figure 2:
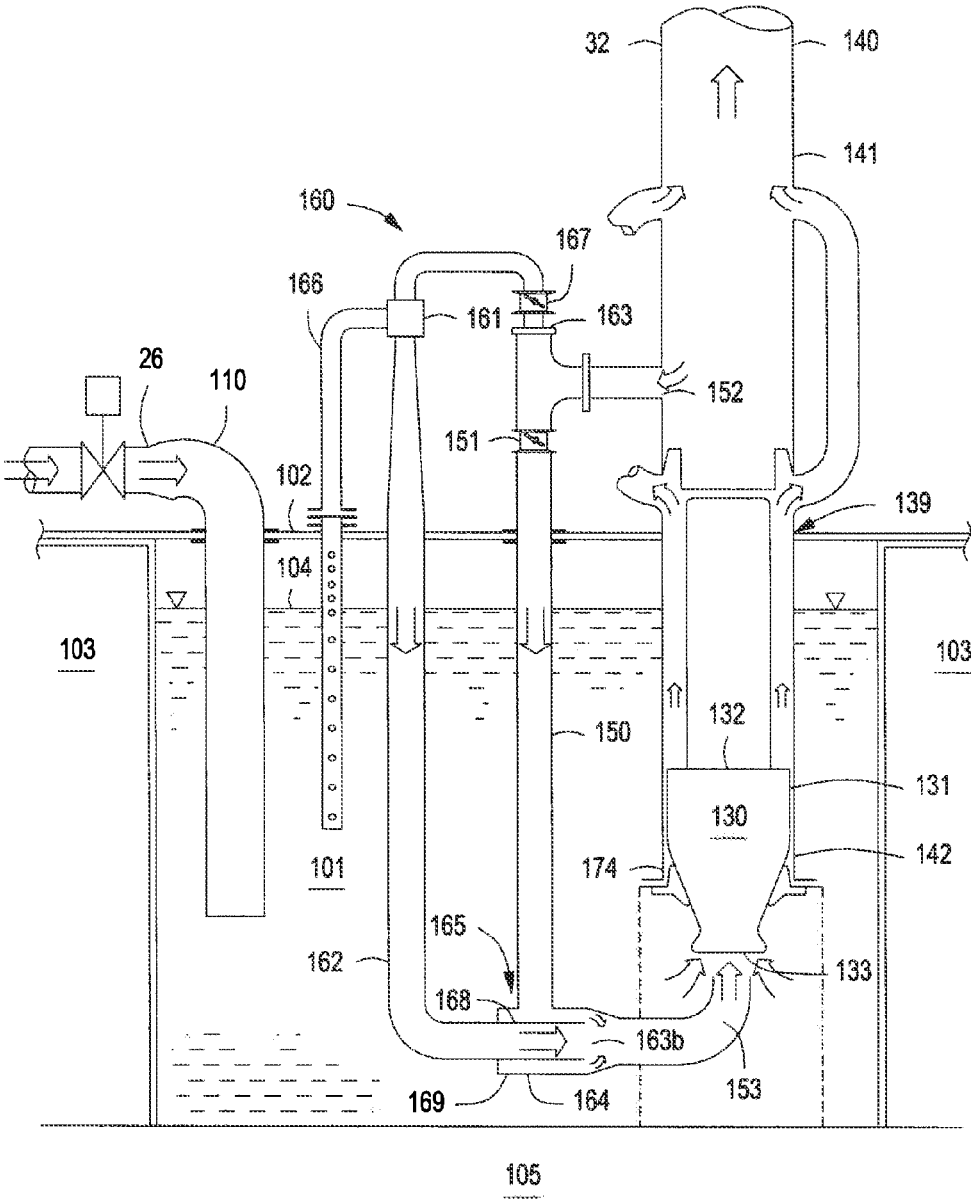
FIG. 2 shows one embodiment of a tank arrangement, according to the present invention, comprising a long caisson.

FIG. 2 shows a tank arrangement 100, according to one embodiment of the present invention, in greater detail and partly with a cross section. More specifically, FIG. 2 shows a storage space 101 formed by a tank wall 102 and parts of adjacent ballast tanks 103 and parts of the hull 105. A water level 104 is also shown. The tank arrangement 100 comprises a liquid inlet 110, in fluid communication with the first inlet conduit 20 mentioned above, in the shown embodiment, a bilge water and ballast water inlet for introducing at least bilge water and/or ballast water into the storage space 101. The tank arrangement 100 is further adapted to at least partly receive a submersible pump 130 for removing at least parts of the water in the storage space 101 and/or for pumping ballast water from e.g. at least one ballast tank, bilge water or the like for temporarily containment in the storage space. The water is thus only passing through the tank arrangement, i.e. it is temporarily contained in the tank arrangement. The tank arrangement 100 is adapted to receive the submersible pump 130 at a submersible pump position 131, which is arranged inside the storage space 101 of the tank arrangement 100 in the shown embodiment. The tank arrangement 100 can be filled by means of gravity or by pumping ballast and/or bilge water to the tank arrangement by the submersible pump.

As is noted, the tank arrangement 100 can be adapted to draw liquid from a plurality of tanks, such as the ballast tank 12 via the first inlet conduit assembly 20, but also from emergency bilge water tanks 30' or other bilge water conduits 30", each conduit can of course be arranged with a flow regulation valve 34', 34".

The tank arrangement 100, according to the present invention, and especially the storage space 101, is significantly smaller than the storage space of a ballast tank, such as ballast tank 12, for example. As can be mentioned, the storage space 101 is about 10, 15, 20, 25, 30, 35 $m^3$. The storage space 101 can typically be about 10-35 $m^3$. The ballast tank 12 is in the order of about 100-1500 $m^3$. The tank arrangement 100 is exerted for a variety of different pressures during normal operation, and it should be noted that the tank arrangement 100 comprises a confined storage space 101, and not an open space to the ambient environment. Thus it may be regarded as a part of a ballast conduit, more than a ballast tank.

Figure 3:
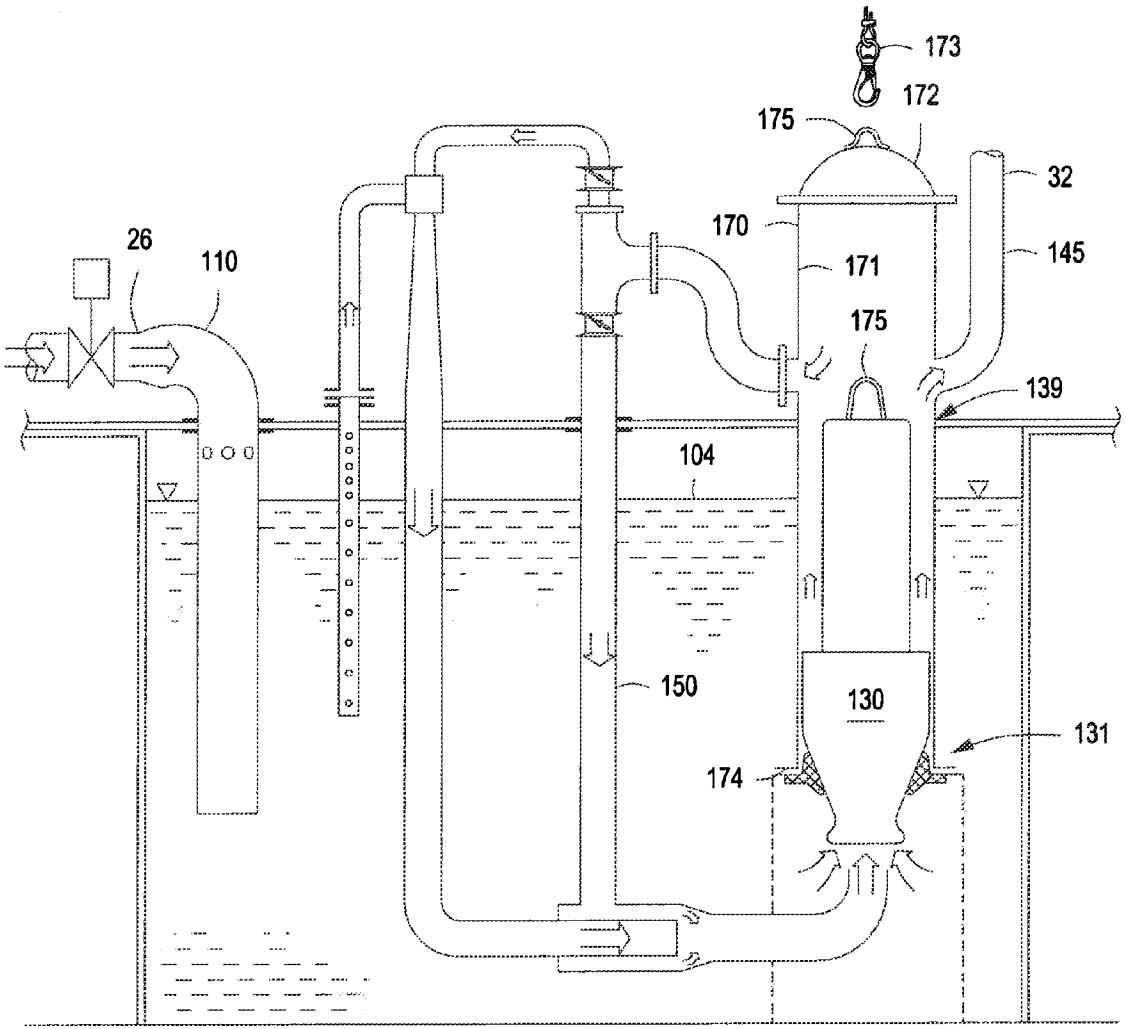
FIG. 3 shows one embodiment of a tank arrangement, according to the present invention, comprising a short caisson equipped with a reclosable lid.

A caisson 140 forms parts of an outlet 139 through which the water can be conducted during removal from the storage space 101. The caisson 140, of which only parts are shown, comprises a first and a second end 141, 142. The submersible pump position 131 is arranged at the second end 142 of the caisson 140, in the storage space 101, i.e. inside the defined space by the tank wall 102, ballast tanks 103 and the hull 105. The second end 142 of the caisson 140 is thus adapted to seal around the submersible pump 130, when positioned in the submersible pump position 131. The caisson 140 can either be adapted to provide a conduit for the water during removal from the storage space 101, i.e. the caisson 140 itself functions as a conduit as shown in FIG. 2, or it can be in fluid communication with a water conduit 145 for removal of the water from the storage space 101, as shown in FIG. 3.

The submersible pump 130 may be any means for moving a liquid but preferably a rotodynamic pump, such as an electrical centrifugal pump, with a capacity of e.g. about 500 $m^3/h$. The submersible pump 130 should however be adapted to operate submerged in water and to be adapted to be able to be on stand by in a submerged condition for a longer period of time. A submersible pump generally has a hermetically sealed motor close-coupled to the pump body to withstand the liquid it is submerged in.

The submersible pump 130 comprises a pump outlet or high side 132 and a pump inlet or low side 133. A circulation conduit 150 is arranged to circulate fluid from the high side 132 of the submersible pump 130, when the submersible pump 130 is in the submersible pump position 131, to the low side 133 of the submersible pump 130 or at least back into the storage space 101. Preferably the circulation conduit 150 is returned directly to the proximity of the low side 133 of the submersible pump 130 or at least directly back into the storage space 101. The circulation conduit 150 enables the submersible pump 130 to be operated in at least a first and a second operating condition. It should be noted that the submersible pump 130 can be considered to be submerged in a conduit system, when submerged in the tank arrangement.

A first operating condition can be a selected volumetric flow rate at the high side 132 of the submersible pump 130 for example, while the second operating condition can be a different volumetric flow rate at the high side 132 of the submersible pump 130. Generally pumps have preferred operating conditions in which they have a beneficial volumetric flow rate. Centrifugal pumps with a volumetric flow which severely deviates from the nominal volumetric flow, for which the pumps are designed, may cause vibrations, mechanical damage due to e.g. cavitation, or bad pump performance. If the volumetric flow rate of the water entering the low side 133 of the submersible pump 130 is below a predetermined desired value, water may be circulated through the circulation conduit 150 in order to increase the volumetric flow rate to thereby obtain a more preferred volumetric flow rate for the submersible pump 130.

For example, if it is realized that the volumetric flow rate of water is to high, the water which is circulated through the circulation conduit 150 can be reduced or the circulation conduit 150 can be closed to completely stop the circulation of water through the circulation conduit 150, in order to decrease the volumetric flow rate and to thereby obtain a more preferred volumetric flow rate for the submersible pump 130.

The circulation conduit 150 is in the shown embodiment provided with a circulation flow valve 151 and comprises an inlet opening 152 and an outlet 153. The circulation flow valve 151 is not necessary, although very advantageous. As an option, the flow can be adjusted by means of changing the diameter of the circulation conduit 150. By means of the circulation flow valve 151, which can be connected directly or indirectly with an electronic control unit (ECU) to operate the circulation flow valve 151 from a remote location, the flow through the circulation conduit 150 can be controlled in a precise way. Thereby an advantageous volumetric flow rate can be provided; enabling very good operating conditions for the submersible pump 130, independently on which operation the submersible pump 130 is intended to be used for.

For example, if the submersible pump 130 is used as bilge pump, relatively low nominal volumetric flow rates are desired, e.g. about 50-110 $m^3/h$. However, if the submersible pump is used as ballast pump relatively high nominal volumetric flow rates are desired, e.g. about 100-500 $m^3/h$, or at least >110 $m^3/h$. The operating conditions, by the means of the circulation conduit 151 and optionally the circulation flow valve 151, can be controlled to provide advantageous operating conditions.

As mentioned, an objective with the present invention is to at least partly to enable advantageous operating conditions for the submersible pump 130. One advantageous operating condition can be to enable a low amount of air, or to enable a reduced amount of air, entering the low side 133 of the submersible pump 130. In an embodiment according to the present invention, the submersible pump 130 is arranged in working cooperation with a priming arrangement 160. In FIG. 2, a priming ejector 161 is arranged in fluid communication with the circulation conduit 150 and the low side 133 of the submersible pump 130, i.e. when the submersible pump 130 is positioned at the submersible pump position 131.

The priming arrangement 160 comprises a priming circulation conduit 162 which extends from the circulation conduit 150 at a first point 163 outside of the storage space 101, and circulates parts of the circulation flow of the circulation conduit 150 to a second point 164 inside of the storage space 101 and down stream of the first point 163, to an ejector outlet **163*b* at a mixing point 165. As is noticed, the mixing point 165 is arranged substantially at the bottom of the storage space, near the hull 105. The circulation conduit 150 and the priming circulation conduit 162 are connected at the mixing point 165 and thereby permits the mixing of the flow from the circulation conduit 150 and the priming circulation conduit 162 before the flow is discharged at the low side 133 of the submersible pump 130, when the submersible pump 130 is positioned at the submersible pump position 131. A priming conduit valve 167 is arranged to enable regulation the flow in the priming circulation conduit 162. The priming conduit valve 167** can of course be connected to the ECU, mentioned above, or any other control unit.

Figure 4:
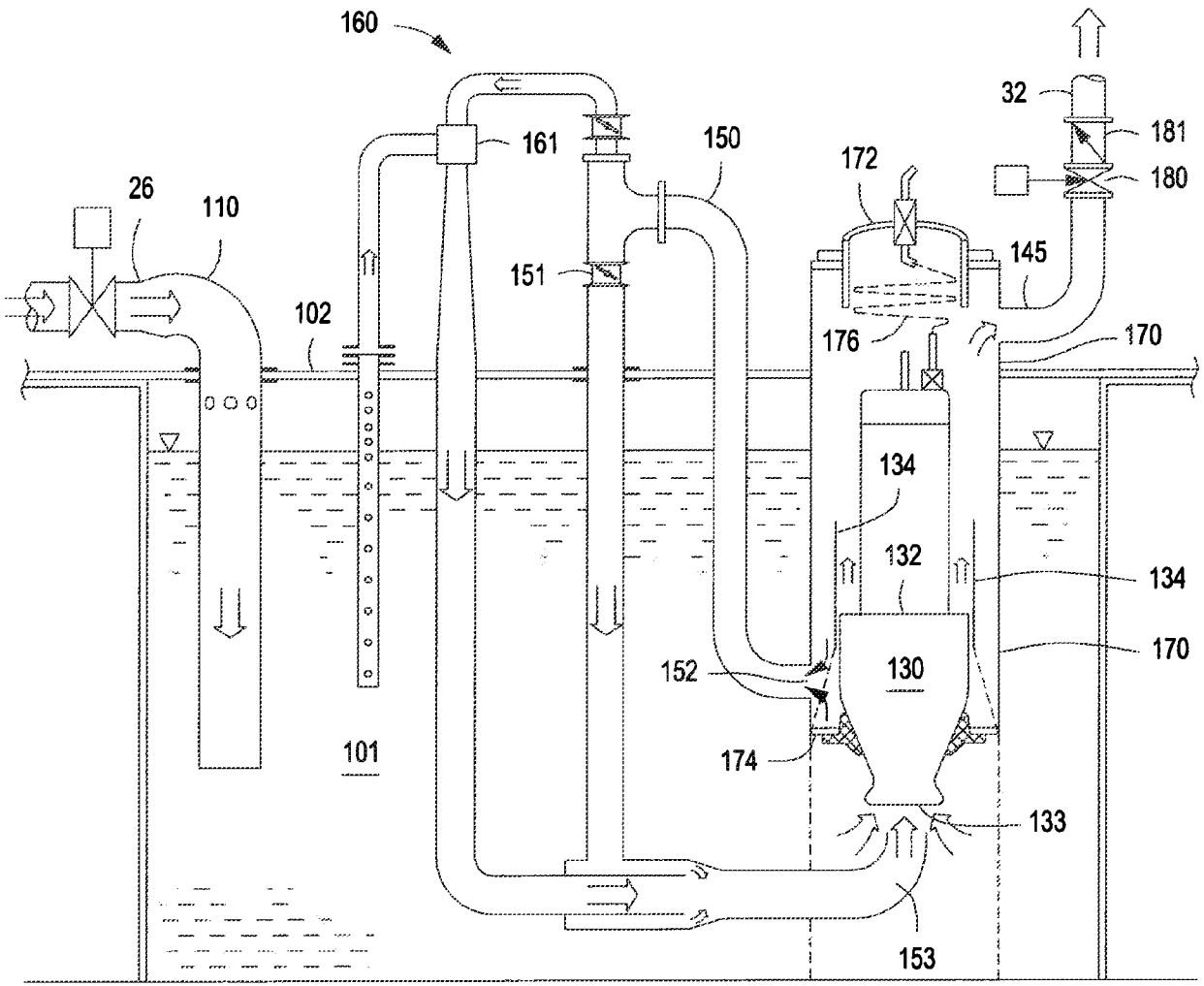
FIG. 4 shows one embodiment of a tank arrangement, according to the present invention, comprising a short caisson equipped with a reclosable lid.

The mixing point 165 is advantageously arranged as shown in FIG. 2-4 in which the mixing point 165 is illustrated as a cross section of mixing point 165, or coupling arrangement 165, the mixing point 165 comprises an inner conduit 168, partly defined by the priming circulation conduit 162 and the ejector outlet **163*b*, and an outer conduit 169, partly defined by parts of the circulation conduit 150, wherein both the inner conduit 168 and the outer conduit 169 are in fluid communication with the low side 133 of the submersible pump 130. Moreover, FIGS. 2-4 illustrates that the outer conduit 169 substantially encloses the inner conduit 168. The outer conduit 169 comprises a tapered portion at the location of the ejector outlet 163*b*. The tapered portion of the outer conduit 169 will ensure that liquid transported through the inner conduit 168 and/or the outer conduit 169 will assume a preferred direction of flow—i.e. a substantially in a direction towards the low side 133 of the submersible pump 130**, and to deviate by turbulent flow.

An air removal conduit 166 is arranged to the priming ejector 161 and permits surplus air, which have been introduced to the storage space 101 from the inlet 110, to be removed from the storage space 101. The air removal conduit 166 comprises a plurality of openings arranged along the removal conduit 166 which, as the water level 104 is lowered, permits a larger amount of air into the air removal conduit 166 by providing a larger inlet opening i.e. a larger area through which air may pass into the air removal conduit 166. The priming ejector 161 pulls the surplus air from the storage space 101 by means of motive power from the water flowing in the priming circulation conduit 162 and introduces the air at the mixing point 165 and thereafter at the low side 133 of the submersible pump 130. The air is thus mixed with an appropriate amount of circulated water to provide an amount of air at the low side 133 of the submersible pump 130 which is adapted not interfere, thereby still providing advantageous operating conditions for the submersible pump 130.

The mixing point 165 can further break air bubbles to smaller air bubbles and/or mix the air bubbles with the water flow of the circulation conduit 150, thereby enabling advantageous operating conditions for the submersible pump 130 for both priming purposes and for the purpose of air removal from the storage space. As is noticed in FIG. 2, the air removal conduit 166 extends from the storage space 101, through the tank wall 102 to the outside, and into the priming circulation conduit 162 at the priming ejector 161.

The recirculation conduit 150 preferably comprises nozzles (not shown) in the proximity of the low side 133 of the submersible pump 130, which nozzles are adapted to disintegrate the air into the liquid. Optionally, as indicated in FIGS. 2, 3 and 4, a mesh or grid can be provided at that part which is equivalent with the submersible pump position 131 and the low side 133 of the submersible pump 130 when the submersible pump 130 is in the submersible pump position 131, to prevent unwanted objects or particles to enter the submersible pump 130. Such a mesh or grid reduces the cost as grids at the inlet 110 of the tank arrangement 100 are not needed.

FIG. 3 shows a second embodiment of a tank arrangement 100 according to the present invention. Similar features will be referred to with similar reference numbers. As is noticed, the opening adapted to receive the submersible pump 130 is not more than a recess 170 having a circular collar 171. The circular collar 171 is adapted to enable a seal between a reclosable lid 172 or optionally parts of the submersible pump 130. The reclosable lid 172 is resting on the circular collar 171.

The reclosable lid 172 enables an operator of a derrick 173 to remove or insert a submersible pump 130 through the outlet 139, into the recess 170 and thereby also into the storage space 101. A short caisson 140, as shown in FIG. 3, enables an operator to move the submersible pump 130 to an alternative or a second tank arrangement similar or different to the tank arrangement 100, according to the present invention, to a service station (not shown), or the like.

A water conduit 145 is arranged to the collar 171 of the recess 170 for removal of the water from the storage space 101 by means of the submersible pump 130. The water conduit can advantageously be extended to the deck of the marine structure, or at least above the sea level enabling emergency bilge water removal, bilge water removal or ballast water removal. As mentioned above, part of the recess 170, and especially the bottom 174, is further adapted to seal around the submersible pump 130, when positioned in the submersible pump position 131.

FIG. 4 shows a tank arrangement 100 according to a third embodiment of the present invention. The tank arrangement 100 comprises as mentioned with reference to FIGS. 2 and 3, a storage space 101, at least one tank wall 102, at least one inlet for introducing bilge water, emergency bilge water or ballast water, a recess 170 for receiving a submersible pump 130 at a submersible pump position 131 and a reclosable lid 172.

The reclosable lid 172 is adapted to permit power and/or control cables 176 to the submersible pump 130 to extend there through or optionally via a cable connection on each side of the reclosable lid 172. The power and/or control cable 176 can however extend through any other wall of the tank arrangement 100. As is noticed in FIG. 4, the power and/or control cable 176 has a designated length, indicated by that the power and/or control cable 176 is illustrated in a serpentine like manner. By having a designated length of the power and/or control cable 176, the submersible pump 130 can be removed from the storage space 101, e.g. by means of the derrick 173, without disconnecting the submersible pump 130 from the power and/or control cable 176, thereby simplifying pump removal or pump service, and reducing the risk of short-circuiting the electrical system.

Figure 6:
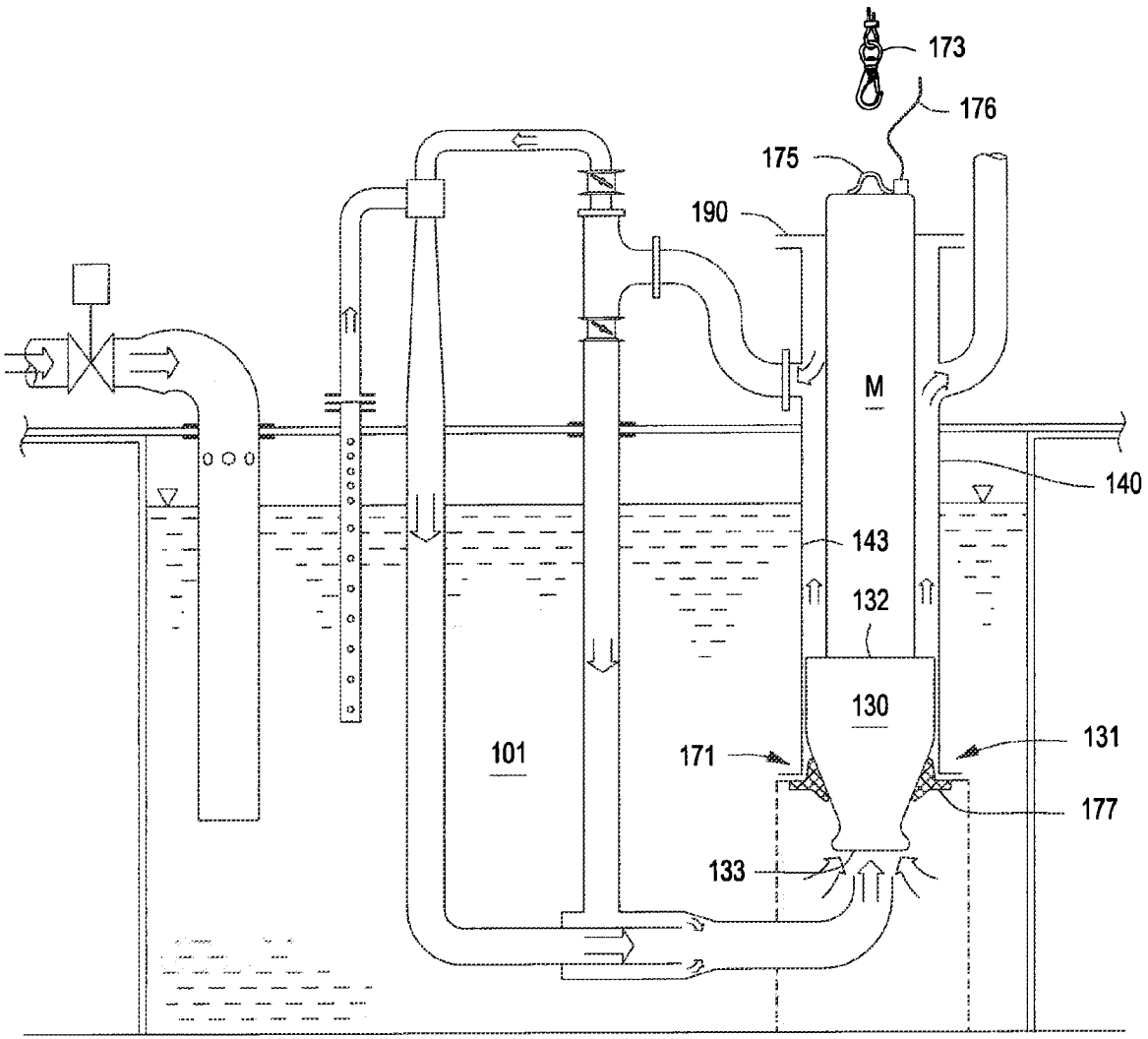
FIG. 6 shows one embodiment of a tank arrangement, according to the present invention, comprising a short caisson and adapted for a submersible pump having a lid function.

Optionally, the submersible pump 130 can be arranged with a recloseable lid function, e.g. by a circumferential flange which is adapted to seal around the recess or caisson 140. This embodiment is shown in FIG. 6. In this embodiment, the submersible pump 130 is adapted to seal the recess or caisson 140 after being inserted into the storage space 101. A sealing flange 177 can be disposed between the submersible pump 130 and an inner surface 143 of the caisson 140, and between the pump inlet 133 and the pump outlet 132. This can be beneficial as the submersible pump 130 during start up and operation is subjected to a torque imparted by the flowing water and e.g. the rotation of the blades of the submersible pump 130, if such are present. In this case, the submersible pump 130 would be fixed to the circular collar 171, or generally fixed with respect to the recess or caisson 140. An additional advantage is that the fittings for the cable and/or control cable 176 can be arranged outside the lid 172, i.e. the dry side, while the remaining submersible pump 130 is arranged on the opposite side of the lid 172, i.e. the wet side.

As an option, the reclosable lid 172 can be adapted to receive a drive shaft for the submersible pump.

In the shown FIGS. 2-4, the submersible pump 130 is introduced vertically from the upper side with respect to the water level 104 of the tank arrangement 100 into the storage space 101, however, the submersible pump 130 can be introduced horizontally or diagonally or in any other direction at a recess similar to the recess 170 of FIGS. 3 and 4.

It should be noted that the at least one inlet 110 for introducing bilge water; emergency bilge water or ballast water can be one single inlet pipe or a plurality of pipes. The plurality of pipes is preferably adapted so that only one pipe, or flow, for the bilge water, emergency bilge water or ballast water respectively can be open. This will prevent the water from flowing between the three different systems. Further visible is a circulation conduit 150 for circulating at least parts of the water back to the storage space 101, after leaving the high side 132 of the submersible pump 130, and the recess 170. Generally the water is circulated from the high side 132 to the low side 133 of the submersible pump 130. A circulation flow valve 151 is arranged to control the flow of the water through the circulation conduit 150.

As is noticed in FIG. 4, the circulation conduit 150 has an inlet opening 152 arranged substantially in the proximity of the bottom 174 of the recess 170. Optionally substantially between the high side 132 and the low side 133 of the submersible pump 130, when the submersible pump 130 is positioned at the submersible pump position 131. The submersible pump position 131 is, as shown FIG. 4 at the bottom 174 of the recess 170.

The circulation conduit 150 thereafter extends trough the tank wall 102 out from the storage space 101 of the tank arrangement 100. The reason for this is that this simplifies the operations and service of the circulation flow valve 151 and other valves arranged to, or in working cooperation with, the circulation conduit 150. As is noticed, the circulation conduit 150 thereafter returns through the tank wall 102 and extends a distance into the storage space 101, preferably back to a position in the proximity of the submersible pump position 131, and preferably the low side 133 of the submersible pump 130 when the submersible pump 130 is in the submersible pump position 131.

The submersible pump 130 is arranged with a water guide collar 134 arranged at the high side 132 of the submersible pump 130, the purpose of the water guide collar 134 is to provide a water pillar for the water which is to be circulated in the circulation conduit 150 to remove access air before the water enters the inlet opening 152 of the circulation conduit 150 and also, or optionally to, provide an appropriate distance for the water to travel, to reduce interference from turbulence form the high side 132 of the submersible pump 130. As such, the recess 170 with the reclosable lid 172 can be operated as a pressure chamber with the function of a separator for removing air from the water which is intended to be circulated to the circulation conduit 150 and the priming ejector 161 of the priming arrangement 160.

As is shown in FIG. 4, the diameter of the recess 170 is somewhat larger than the diameter of the submersible pump 130. This is to enable the water to reach the inlet opening 152 of the circulation conduit 150 with minimum content of air.

The submersible pump 130 can further be arranged with a lifting device 175, such as a steel ring or the like. The submersible pump 130 can optionally be arranged to a guide rail, a hose or the like to enable the submersible pump 130 to be introduced into the storage space 101 of the tank arrangement 100. The tank arrangement 100 can thus be provided with means for removing the submersible pump 130 from the tank arrangement 100.

The tank arrangement 100, as described above, can be provided with a water level indicator (not shown) which can be used together with an ECU, programme logic controller, computer or the like, e.g. as mentioned above, to regulate and control the different flows in the tank arrangement 100, and the operating conditions of the submersible pump 130, as well as the submersible pump 130 itself. As a non limiting example, the water level indicator can be operated in conjunction with the circulation flow valve 151 of the circulation conduit 150, the priming conduit valve 167 and e.g. the submersible pump 130 and a regulating valve 180. This operation should preferably be automatically controlled, e.g. by the ECU or any other computerized device communicating with the ECU, and with such performance that the water level inside the storage space will not go below the minimum water level, indicated min. in FIG. 5. By this arrangement the impeller of the submersible pump will be water filled and ready for operation at all time.

If the submersible pump 130 is to be used as a regular bilge water pump, both the circulation flow valve 151 of the circulation conduit 150, the priming conduit valve 167 are fully opened. Further flow control is performed by throttling the regulating valve 180. This will provide an operating condition for the submersible pump 130 which is very advantageous.

As is further noticed FIG. 4 also shows a regulation valve 180 and a check valve 181 (a non return valve) in the proximity of the recess 170 and the water conduit 145 for removal of the water from the storage space 101, also referred to as the liquid discharge assembly 32 above. In the embodiment shown in FIG. 2, with a long caisson 140, the regulation valve 180 and a check valve 181 is advantageously arranged between the upper end of the caisson 140 and the overboard conduit, arranged to discharge the water overboard somewhere above the sea level. A cut off valve should also be arranged at the proximity of the outside planking of the marine structure.

Figure 5:
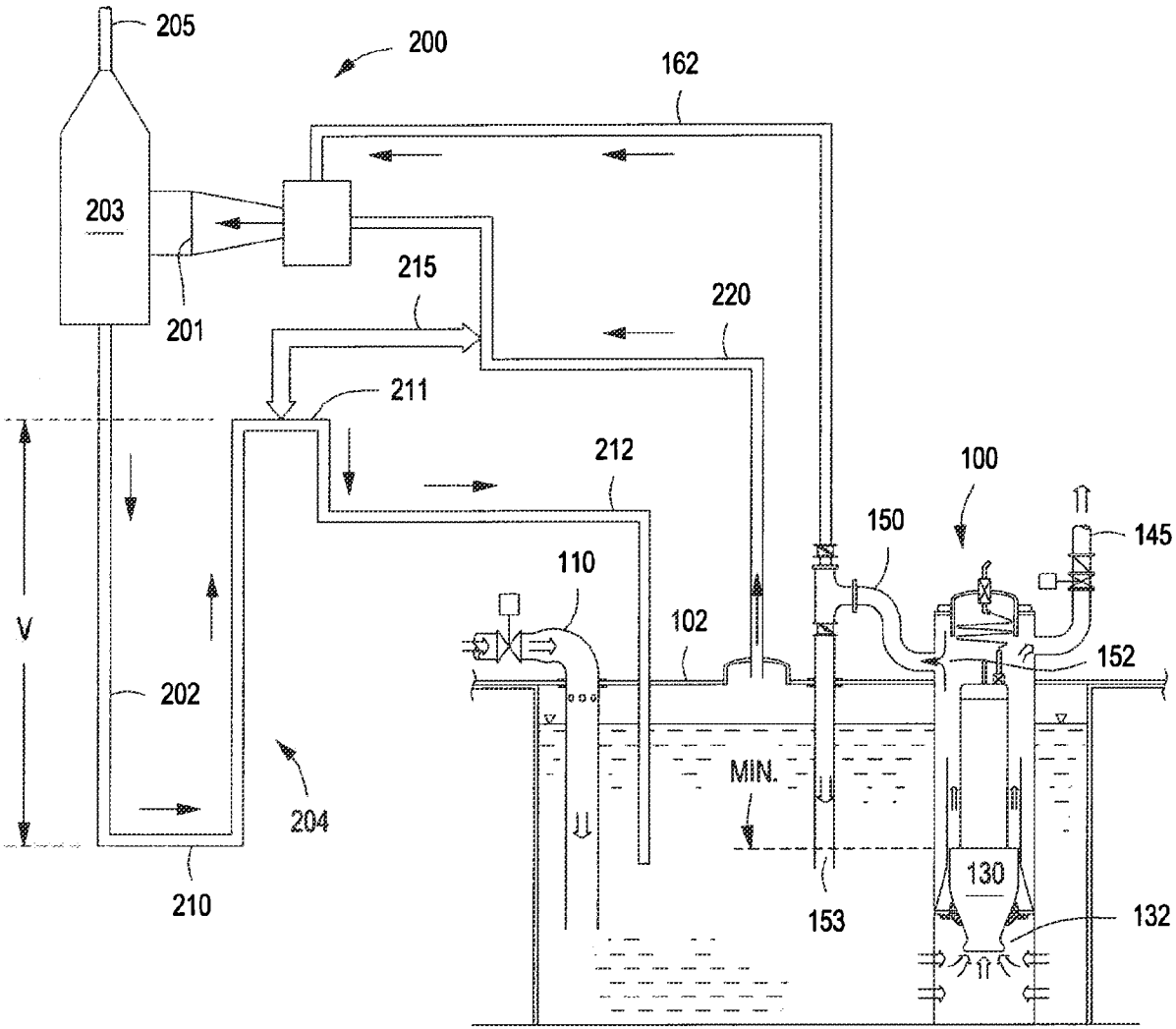
FIG. 5 shows one embodiment of a tank arrangement, according to the present invention, comprising a short caisson having an air discharge outlet outside of the storage space.

According to one aspect of the invention, a minimum level of water, indicated as "min." in FIG. 5, is retained in the storage space 101 as this will make certain that the submersible pump 130 always is drenched before start up. The minimum level of water is preferably set to be above the submersible pump position 131 to thereby always keep at least parts of the submersible pump 130 submerged, or advantageously the whole of the submersible pump 130 submerged. This will be discussed in greater detail below.

FIG. 5 shows an alternative embodiment of the present invention in which an air separator is arranged to remove air collected at the top of the storage space 101 of the tank arrangement 100. However, the separated air is not returned the storage space 101 or the low side 132 of the submersible pump 130. The separated air is instead directed out and away from the tank arrangement 100 and the preferably away from the marine structure, into the ambient air outside the marine structure.

When liquid flows in the priming circulation conduit 162, so as to feed the priming ejector in FIG. 5 referred to as the priming ejector 200, to thereby impart a motive power to the air in the storage space 101 via the air outlet conduit assembly 220. The air outlet conduit assembly 220 is arranged to the tank wall 102 and a dome to promote air to be sucked out from the storage space 101. A mixture of air and liquid will leave the priming ejector 200 through a priming ejector outlet 201 which in turn is in fluid communication with a restoring conduit assembly 202 which in the FIG. 5 embodiment comprises a restoring separator 203 and a liquid seal 204. The priming ejector outlet 201 may preferably discharge into the restoring separator 203. The restoring separator 203 further comprises an air discharge conduit 205 such that air in the restoring separator 203 may leave the tank arrangement 100 of the present invention and is preferably directed into the ambient air of the marine structure.

The liquid seal 204 preferably comprises a conduit—or a plurality of conduits joined together so as to form a continuous conduit arrangement—which in turn comprises a lower bend 210 and an upper bend 211, wherein the lower and upper bends 210, 211 are distanced from one another by a vertical distance V, which vertical distance preferably is more than 10 meters, more preferably >11 meters, optionally in the range of 10-15 meters.

Furthermore, the priming circulation conduit 162, the restoring conduit assembly 202, the conduit 212 from the upper bend 211 and portions of the first inlet conduit assembly 20 together form a motive fluid recirculation conduit assembly for the tank arrangement 100, which motive fluid recirculation conduit assembly provides a fluid communication between the high side 132 and the low side 132 of the submersible pump 130, when the submersible pump 130 is in the submersible pump position 131, to thereby enable liquid transport from the high side 132 to the low side 132 of the submersible pump 130. The motive fluid recirculation conduit assembly just described may in some embodiments of the present invention be the only recirculation conduit 150 of the tank arrangement 100 adapted to provide a fluid passage from the high side 132 to the low side 133 of the submersible pump 130.

It should be noted that the FIG. 5 tank arrangement 100 also comprises a cut-off conduit assembly 215 providing a fluid communication between the liquid seal 204—preferably at the location of the upper bend 211—and an air outlet conduit assembly 220 which is in fluid communication with the storage space 101 of the tank arrangement 100 in order to reduce the risk of having the liquid seal 204 emptied of liquid due to inter alia a siphon action.

FIG. 6 shows an additional embodiment in which the tank arrangement according to the present invention is adapted to a submersible pump 130 which has a reclosable lid function. The submersible pump 130 comprises a sealing and connection means, such as the sealing and connection flange 190, for providing a connection and a liquid and pressure tight seal to the caisson 170. As is noticed the power and/or control cables are arranged directly to the submersible pump, and especially to that part of the submersible pump representing the electric motor M.

The tank arrangement 100 can be used for separating air which during certain circumstances travels with the flow in the at least one fluid inlet 110. It should be noted that the term separate air does not mean that the tank arrangement 100 can separate air dissolved in the water but air which travels with the water as bubbles or distinct air pockets. The separated air can be removed by the means for removing air 160, which is described above. The removal of air keeps the storage space 101 filled with a normal water level. In cases of exceptional amounts of air entering the storage space 101 and the water level is decreased, the regulating system can be engaged to start; the priming; additional circulation if the water level in the storage space 101 is still decreasing, the regulating valve 180, i.e. a valve regulating the out flow form the storage space 101, can be closed, or at least reduced, to prevent water from escaping the storage space 101.

When the regulating valve 180 is reduced or closed, the flow through the at least one fluid inlet 110 is reduced or stopped, which also has the advantage of preventing or reducing the amount of air entering the storage space 101, until balance is restored in the storage space 101, i.e. at least the minimum level of water is maintained or reached. The minimum level of water, indicated min. in FIG. 5, is surpassed if the flow of air if without restrain, e.g. if the storage space 101 is completely emptied of water and the operator is still pumping using the submersible pump 130. The regulation system has automatically, or via an operator, at that stage initiated both priming and recirculation and further closed the regulating valve 180. No water leaves the storage space 101 but the priming and circulation is still in operation. The water level in the storage space 101 can thus be maintained at a reasonable level and not go below the minimum water level, indicated min. in FIG. 5. By this, the submersible pump 130 can still be operable but without pumping water e.g. overboard, via the at least one fluid outlet 145.

The advantages are that the submersible pump 130 always can be kept submerged in water, permitting the submersible pump 130 to always be ready for start. At start up, the priming and the circulation is started until the storage space 101 is filled and normal pumping out through the fluid outlet 145 can be performed.

The invention claimed is:

1. A ballast system for a marine structure, comprising:

a ballast tank in fluid communication with a tank arrangement via a first inlet conduit, wherein said tank arrangement comprises:

a closed storage space defined by at least one tank wall;

at least one fluid inlet in fluid communication with said first inlet conduit that introduces a bilge fluid, a ballast fluid, or both into said storage space; and at least one fluid outlet that removes at least a portion of said bilge fluid, said ballast fluid, or both from said storage space;

wherein said at least one fluid outlet is at least partially formed by a caisson containing at least a portion of a submersible pump, wherein said submersible pump comprises a pump outlet and a pump inlet, wherein said caisson comprises a space between said submersible pump and an inner surface of said caisson that receives fluid from said pump outlet, and wherein said caisson further comprises at least one circulation conduit having an inlet and an outlet that circulates at least a portion of said bilge fluid, said ballast fluid, or both from said pump outlet to said pump inlet;

a priming ejector that removes air from said storage space, wherein said priming ejector is in fluid communication with an air discharge conduit comprising a plurality of apertures arranged along a length thereof, wherein said air discharge conduit discharges said air outside of said storage space, and wherein said priming ejector is coupled to said caisson and said at least one circulation conduit at a location outside of said storage space; and a priming circulation conduit having a first end coupled to said priming ejector and a second end coupled to an ejector outlet for ejecting at least air, said ejector outlet of said priming ejector is arranged inside of said storage space and proximate said submersible pump to enable said submersible pump to remove said air.

2. The ballast system according to claim 1, wherein said at least one circulation conduit comprises at least one circulation flow valve for regulating fluid flow at said outlet of said circulation conduit.

3. The ballast system according to claim 1, wherein said submersible pump extends out of said caisson and into said storage space and wherein said outlet of said circulation conduit is disposed in said storage space and proximate said submersible pump.

4. The ballast system according to claim 3, wherein said inlet of said at least one circulation conduit is coupled to said caisson and said outlet of said circulation conduit is offset from said inlet of said submersible pump.

5. The ballast system according to claim 4, wherein said circulation conduit extends through said at least one tank wall into said storage space.

6. The ballast system according to claim 1, wherein said caisson comprises a first end and a second end and said submersible pump comprises an upper portion and a lower portion, wherein said second end terminates in said storage space, and wherein said pump inlet is disposed in an end of said lower portion and said end of said lower portion is disposed outside of said caisson.

7. The ballast system according to claim 6, wherein said caisson further comprises a closable lid on said first end.

8. The ballast system according to claim 6, wherein said pump inlet is disposed upstream of said caisson and a sealing flange is disposed between said submersible pump and an inner surface of said caisson between said pump inlet and said pump outlet.

9. The ballast system according to claim 8, wherein said caisson extends a distance past said at least one tank wall and away from said storage space of said tank arrangement.

10. The ballast system according to claim 1, wherein said air discharge conduit is arranged substantially parallel to said at least one circulation conduit in said storage space.

11. The ballast system according to claim 1, wherein said tank arrangement separates air from said fluid that enters said storage space from said at least one fluid inlet.

12. The ballast system according to claim 1, wherein said tank arrangement maintains a minimum level of fluid in said storage space to maintain said submersible pump at least partly submerged.

13. The ballast system according to claim 1, wherein said ejector outlet comprises a housing containing at least a portion of said second end of said priming circulation conduit, wherein said housing is coupled to said circulation conduit.

14. The ballast system according to claim 13, wherein said ejector outlet is axially aligned and offset from said pump inlet.

15. The ballast system according to claim 13, wherein a bottom portion or a top portion of said caisson is adapted to seal around said submersible pump.

16. The ballast system according to claim 15, wherein said submersible pump comprises a sealing and connection flange providing a connection and a liquid and pressure tight seal between said submersible pump and said caisson.

17. The ballast system according to claim 14, further comprising a power cable attached to said submersible pump, wherein said power cable is of sufficient length for removing said submersible pump from said submersible pump position without disconnecting said power cable.

18. A marine structure having a ballast system, said ballast system comprising:

a ballast tank in fluid communication with a tank arrangement via a first inlet conduit, wherein said tank arrangement comprises:

a closed storage space defined by at least one tank wall;

at least one fluid inlet in fluid communication with said first inlet conduit that introduces a bilge fluid, a ballast fluid, or both into said storage space; and at least one fluid outlet that removes at least a portion of said bilge fluid, said ballast fluid, or both from said storage space;

a circulation conduit having an inlet and an outlet that circulates at least a portion of said bilge fluid, said ballast fluid, or both from said pump outlet to said pump inlet;

a priming ejector coupled to said circulation conduit and an air discharge conduit comprising a plurality of apertures arranged along a length thereof;

wherein said at least one fluid outlet is at least partially formed by a caisson containing at least a portion of a submersible pump, wherein said submersible pump comprises a pump outlet and a pump inlet, wherein said caisson comprises a space between said submersible pump and an inner surface of said caisson that receives fluid from said pump outlet, wherein said caisson comprises a first end disposed outside said storage space and a second end that terminates in said storage space, and wherein said pump inlet is disposed outside of said caisson; and a priming circulation conduit having a first end coupled to said priming ejector and a second end coupled to an ejector outlet for ejecting at least air, said ejector outlet of said priming ejector is arranged inside of said storage space and proximate said submersible pump to enable said submersible pump to remove said air.

19. A method for pumping ballast fluid, bilge fluid, or both using a ballast system according to claim 13, wherein said method comprises circulating at least a part of said ballast fluid, said bilge fluid, or both back from said outlet of said submersible pump to said storage space to maintain a minimum level of fluid in said storage space.

20. The method according to claim 19, wherein said ballast fluid, said bilge fluid, or both is circulated to a position proximate said inlet of said submersible pump.

21. The method according to claim 19, wherein said circulated ballast fluid, bilge fluid, or both is regulated by a circulation flow valve.

22. The marine structure according to claim 18, wherein said ejector outlet comprises a housing containing at least a portion of said second end of said priming circulation conduit, wherein said housing is coupled to said circulation conduit.

23. The ballast system according to claim 22, wherein said ejector outlet is axially aligned and offset from said pump inlet.

* * * * *